United States Patent [19]

Maurin

[11] Patent Number: 4,503,797

[45] Date of Patent: Mar. 12, 1985

[54] SAIL ROLLING AND STORING DEVICE

[75] Inventor: Suzanne M. Maurin, Le Puy, France

[73] Assignee: Societe Anonyme: Leisystem, France

[21] Appl. No.: 435,297

[22] Filed: Oct. 20, 1982

[30] Foreign Application Priority Data

Oct. 23, 1981 [FR] France ..... 81 20274

[51] Int. Cl.[3] ..... B63H 9/10

[52] U.S. Cl. ..... 114/106; 114/97; 114/102; 114/104

[58] Field of Search ..... 114/39, 102, 104–107, 114/112; 160/243, 247, 254, 270

[56] References Cited

U.S. PATENT DOCUMENTS

| | | | |
|---|---|---|---|
| 2,119,475 | 5/1938 | Tamm | 114/107 |
| 3,260,230 | 7/1966 | Kauert | 114/102 |
| 4,116,152 | 9/1978 | Larsson | 114/39 |
| 4,354,444 | 10/1982 | Poretic | 114/104 |
| 4,449,468 | 5/1984 | Schulz et al. | 114/97 |

FOREIGN PATENT DOCUMENTS

| | | | |
|---|---|---|---|
| 7843 | of 1911 | United Kingdom | 114/104 |
| 1109073 | 4/1968 | United Kingdom | 114/105 |
| 1287258 | 8/1972 | United Kingdom | 114/104 |
| 1408004 | 10/1975 | United Kingdom | 114/104 |

*Primary Examiner*—Trygve M. Blix
*Assistant Examiner*—Patrick W. Young
*Attorney, Agent, or Firm*—Bacon & Thomas

[57] ABSTRACT

A device for rolling and storing a sail associated with a rolling boom, including a sheath of deformable material encircling the boom and provided with rigid edges defining a slit for passing the sail therethrough, wherein the sheath is carried by the boom for free pivotal movement and includes a transverse cross-sectional area at least equal to that of the boom and the sail completely rolled thereon.

16 Claims, 18 Drawing Figures

Fig. 1
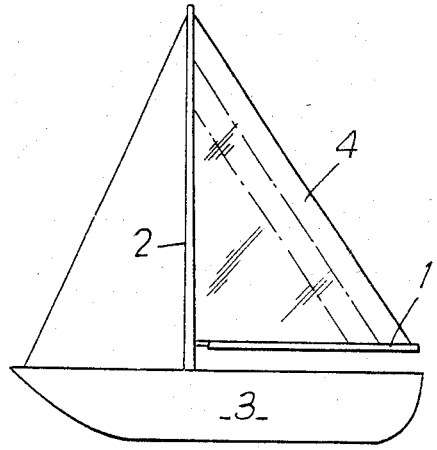
Fig. 3
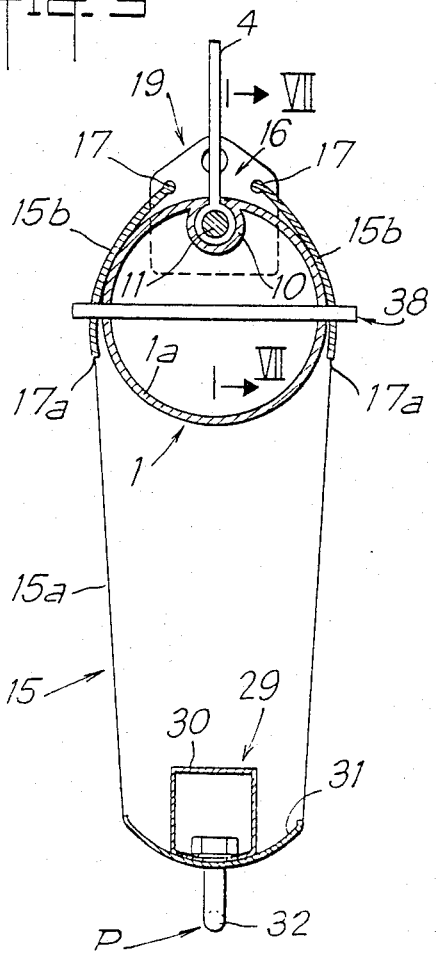
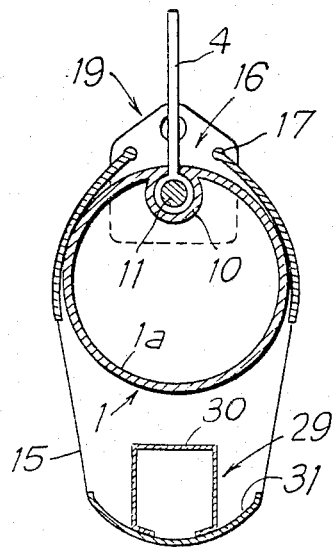
Fig. 4

14
13
V
IV
18
IV
V
7
8
15b
1
29
10
30
9
4
1a
11
32
III
III
P
35
42
15a
33
15b
12
15
2
28
19
5
6

4
16
17
15b
15
15a
35
50
C
10
11
1a
1
19
17a
29
32
P
49
39
39a
38a

SAIL ROLLING AND STORING DEVICE

The present invention relates to the means used for setting, adjusting and storing a ship sail, and it more particularly relates to mainsail devices or the like, using a setting structure comprising a generally vertical mast, and a generally horizontal boom.

The conventional structures of the aforesaid type mainly solve the problems of setting a sail of which the exposure to the wind has been predetermined. But other types of problems also have to be solved.

One of these is the necessity of storing the unused part of the sail, when the boat is berthed for example.

Another problem is to be able to adjust the surface of the sail receiving the wind in relation to the required speed of the boat or to the atmospheric conditions.

To solve these two types of problems, a first technical solution has been proposed which consists in fastening the edge of a sail on a boom and hoisting it axially to the mast. Using reef-points, fitted at successive levels on the two faces of the sails, it is possible to set part of the sail only, whilst holding the non-set surface in the form of successive reefs at the level of the boom.

Obviously, the aforesaid means require particularly strong physical energy and an important crew for a wide surface of sail. In addition, the manoeuvers are long and complex and do not permit a ready adaptation to a change of speed or to a change of meteorological conditions.

The storage of such a sail is obtained by forming successive folds, i.e. by furling the sail and then securing it to the boom by way of furling lines. Normally, a furled sail is protected by a belayed awning. This type of assembly is unsightly. Moreover, the storage for undetermined periods of time and in variable atmospheric conditions, of all or part of a sail, as indicated hereinabove, very often leads to the sailcloth being damaged and requiring expensive repairs.

Other means have also been proposed to try and solve the aforementiond problems. These consist generally in a boom mounted for pivoting on a mast by way of a universal or Cardan joint. The combination of the boom with the mast is completed by a mechanism provided for rotating said boom about its axle. Besides these means, the boom is produced in the form of a cylindrical mandrel and comprises on its external peripheral surface, an open tunnel designed to receive the bolt rope which can be hoisted therethrough, via a tautening or hoisting device, which is normally accessible from the free end of the boom.

Such means are generally found to be satisfactory because, by slackening the bolt rope and releasing the mast halyard permitting to hoist the hoist rope, it is possible to control the pivoting movement of the boom. The sail can thus be rolled or unrolled in successive spires, thereby offering an active surface which can be readily set in relation to the speed required for the boat or to the atmospheric conditions. On these points, the known means are completely satisfactory.

It has however been found that the sail, stored in this way by being rolled on a boom, was in fact subject to unavoidable damages, which are mainly due to its permanent exposure to the elements, as well as to the ultraviolet rays of the sun. The question was therefore raised to find a rolling and storing device capable of eliminating the disadvantages encountered with these rolling booms.

A solution to this problem which seems obvious could be to build the boom according to the technique of a known storing boom, which storing boom comprises on the inside a storing space containing a mandrel of small cross-section permitting to roll, from the hoist side, a sail which traverses an axial slit provided in the mast. The building technique would then consist in producing a boom in the same way, the slit through which the sail passes, being provided level with the summit surface portion.

But in actual fact, such a solution is not really feasible as the booms would have to have completely incompatible cross-sections. Indeed the length of the hoist of a sail being in general three to three and a half times its edge, it would be very difficult to roll even a small sail over a diameter less than 200 mm.

Moreover, the necessity of providing a slit in the summit portion of the boom, implies a reinforced construction such as for example with parallel double boxes, in order to give the boom enough mechanical strength to withstand bending, buckling and twisting stresses. Such a construction would in the end make the boom particularly heavy, whereas the aim is on the contrary to try and make it as light as possible. By way of example, a boom of 100 mm cross-section and 4.20 m long weighs according to the conventional productions, around 14 kg. A rolling boom showing the same characteristics would have a diameter of between 230 and 350 mm and would weigh 40 kg, i.e. three times the weight of a conventionally known boom. It was therefore impossible to consider transposing the known technique of mast construction to the construction of a rolling boom.

The object of the invention is to propose a new device, for rolling and storing a sail from the bolt rope, which device can, besides offering the known characteristics of setting, storing and adjusting, solve the storage problems and the problems of protection against the elements and against the sun radiations.

The object of the invention is also to propose a device which is especially adaptable to existing rolling booms, and as such adaptable to meet the requirements, whatever the type of boom to be equipped.

Another object of the invention is to propose a relatively simple and inexpensive device whilst ensuring an efficient protection of the sail.

Yet another object of the invention is to propose a device of small overall weight, which will have only very little effect on the drag coefficient of the rig assembly.

One advantage of the invention resides in the simplicity of the device used which makes it possible to obtain a rapid assembly or dismantling without the help of an experienced crew.

A final object of the invention is to provide a storage and protection device which does not limit the operations normally conducted on the boom to adapt the characteristics of the latter to the navigating conditions.

These objects are reached according to the invention with a sail rolling and storing device of the type comprising a boom mounted for pivoting by one of its ends to a mast, in such a way as to extend in cantilevered manner substantially horizontally, said boom being associated to a mechanism for rotating it about its axle, means being provided in its peripheral wall for holding and hoisting the side of a sail, the bolt rope of which is designed to be held on the mast, such a device being characterized by a sheath of deformable material:

encircling the boom substantially over its full entire length, defining a slit, with rectilinear and rigid edges, parallel to the axle of the boom and through which passes the sail, mounted for pivoting freely with respect to the boom, and defining a general cross-section at least equal to the diameter of the boom with the sail completely rolled.

The present invention will be more readily understood on reading the following description with reference to the accompanying drawings, in which:

FIG. 1 is a diagrammatical view of a sailing boat,

FIG. 2 is a side elevation, illustrating on a larger scale the object of the invention, FIGS. 3, 4 and 5 show on a larger scale, cross-sections along lines III—III, IV—IV and V—V of FIG. 2, FIG. 6 shows part of an elevational section along line VI—VI of FIG. 5, FIG. 6*a* shows part of an elevational section similar to that shown in FIG. 6, but illustrating a variant embodiment, FIG. 7 shows part of an elevational section along line VII—VII of FIG. 3, FIGS. 8 and 9 are two elevational views of cross-sections illustrating two different stages of utilization of the device according to the invention, with reference to FIG. 3.

Figure 2:
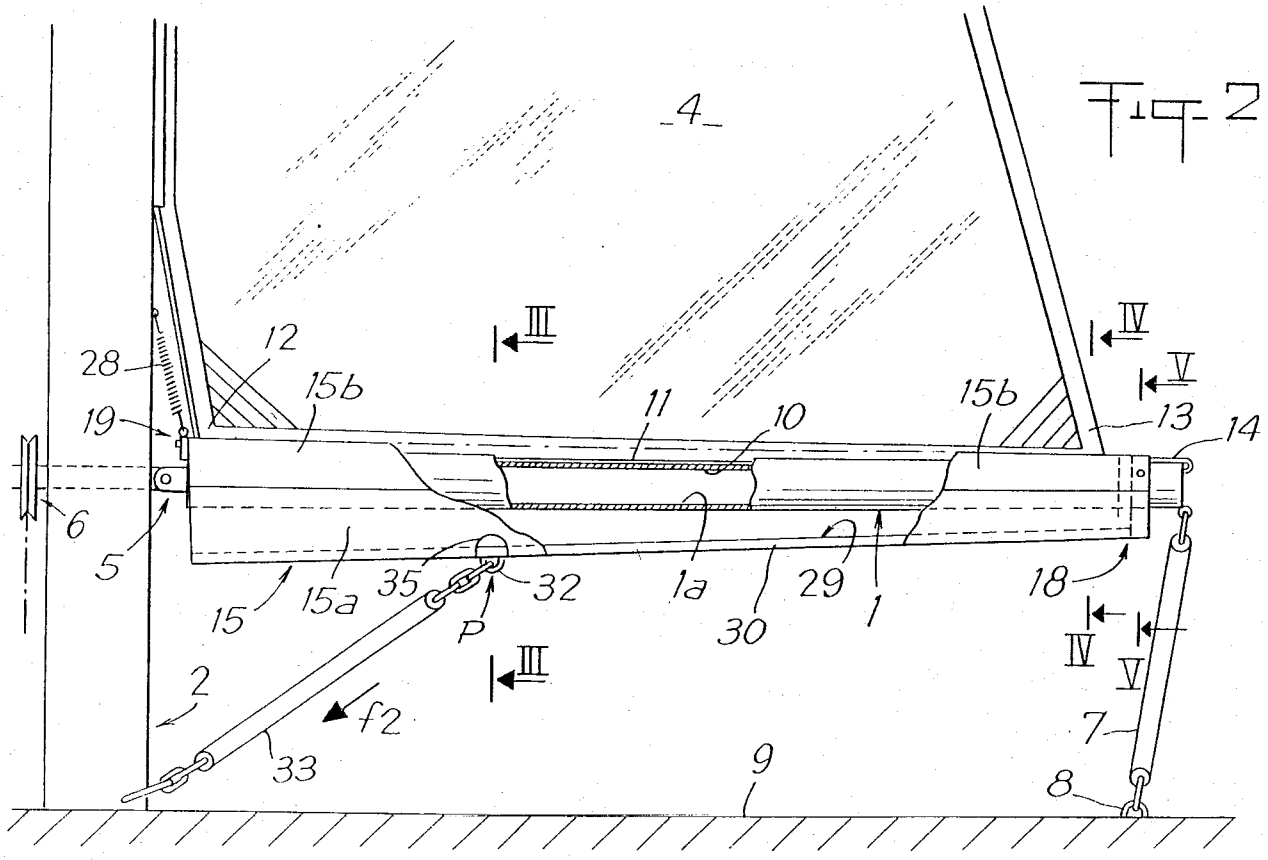

The sail rolling and storing device is used with a boom 1 associated to a mast 2 rising up from the deck of a boat 3, diagrammatically represented in FIG. 1. The boom 1 and mast 2 are used for setting a sail 4 which is illustrated in the drawings, by way of example, in the form of a marconi rigging. But the object of the invention also finds a similar application with a different type of rigging and in particular with a fore-and-aft rigging.

A boom comprises, in known manner and as illustrated in FIGS. 2 and 3, a mandrel 1*a* of cylindrical or oval cross-section, which is mounted on the mast by way of a Cardan or universal type joint 5. Said joint 5 is connected to a mechanism 6 driving the mandrel 1*a* in rotation about its axle. The free end of the mandrel 1*a* can be held via a sheet 7 which is fastened to a traction point or clew 8 provided on the deck 9 of the boat 3.

The mandrel 1*a* can be produced from various materials and is provided on its peripheral surface with an axial groove or tunnel 10 extending over its entire length. Said tunnel 10 is designed to allow through and hold therein a bolt rope 11 fitted on the sail 4. Said bolt rope 11 can be hoisted between the reinforcing point 12 and the sheeting point 13 via a hoisting device 14.

FIG. 1 shows that the sail 4, in order to expose its entire surface to the wind, has been set by way of a mast halyard permitting the bolt rope to slide through a suitable tunnel provided in the mast. From this point, the tension of the mast halyard can be eased off to allow the rotation of the boom 1 for the purpose of rolling up the sail 4 in successive spires. This permits to reduce the surface of the sail within predetermined proportions, such as illustrated in broken lines in FIG. 1, and consequently to adapt the reactions of said sail to the navigating or atmospheric conditions. The sail when completely rolled on the boom, is stored in suitable conditions and can be readily re-set at any time.

According to the invention, a boom of the aforesaid type is equipped, as shown in FIGS. 2 to 4, with a sheath 15 in deformable material. The sheath 15 can be constituted by a perforated or unperforated sheet or film of textile or plastic material or of a laminated composition. Said sheath 15 can also be a thin sheet of suitable metal. The shape of the sheath 15 is adapted to that of the boom 4 when the sail is completely rolled, i.e. it can be either cylindrical or truncated correspondingly thereto. Said sheath 15 is designed so as to define an enclosure with a general internal space for storage of section at least equal to the general section of the boom 1, when the sail is completely rolled.

Said sheath 15 is designed to encircle the boom 1 over substantially the full length thereof, while being so arranged as to retain a possibility of independent relative rotation. In actual fact, the sheath 15 is mounted so as to be able to accept the independent rotation of the boom 1 and to be moved angularly with respect to the axis of the latter, in special conditions of use, as will be explained hereinafter. The sheath 15 is produced so as to define a slit 16 with two rigid parallel edges 17 extending over the full length of the boom 1. Said slit 16 is normally arranged so as to coincide with the bolt rope tunnel when the boom is in a condition corresponding to the complete unrolling of the sail 4. Said slit 16 thus ensures a through way for the sail, as illustrated in FIGS. 3 and 4.

Figure 5:
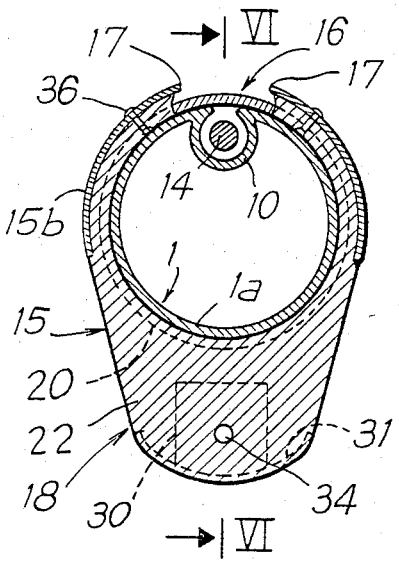
Figure 6:
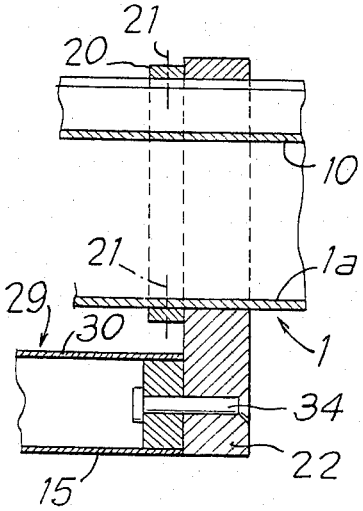

To make sure that the aforesaid conditions are always met, the sheath 15 is mounted on the boom 1 via two end elements of support and axial abutment 18 and 19, respectively. Element 18, illustrated in FIGS. 5 and 6, comprises a ring 20 secured axially and angularly on the mandrel 1*a* of the boom 1. The ring can be produced from different materials and be secured to the boom 1, for example by means of rivets or screws 21. The ring 20 is set off from the free end of the boom 1, leaving an axial distance which is at least equal to the thickness of an endpiece 22, which endpiece is freely threaded over the mandrel 1*a*, to be brought in supporting abutment against the ring 20. Said endpiece 22 can pivot on the mandrel 1*a* and joins up with the corresponding end portion of the sheath 15.

Figure 7:
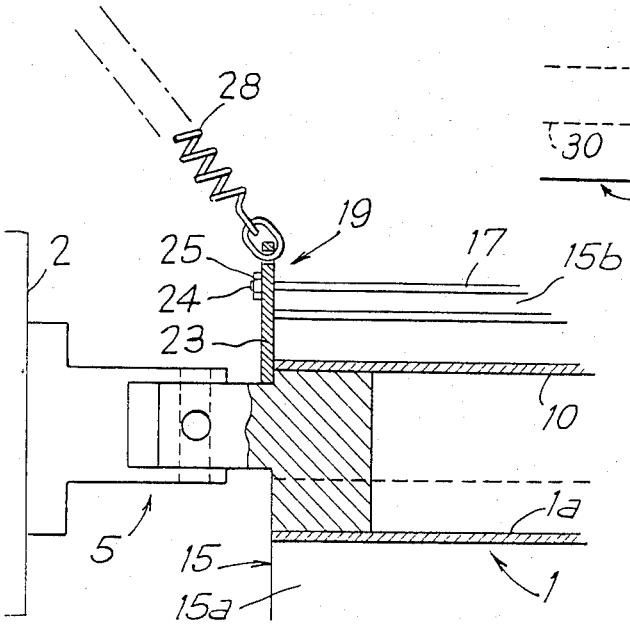

The piece 19 is constituted, as shown in FIGS. 3 and 7, by a plate 23, which plate is perforated to allow the engagement of two pins 24 which are formed in extension of the edges 17 of the sheath 15 defining the slit 16. The pins 24 are secured axially in the plate 23 by way of nuts 25. The height of plate 23 is so selected that, in the position of the sleeve corresponding to a rest position, wherein said sheath rests against the free upper part of the boom, the said plate is resting axially against the transverse face of the boom which is directed towards the mast 2. Said plate 23 could be replaced by two lips mounted for pivoting on the pins 24 and joined together by their opposite end by a shackle fastened to the mast by way of a cable.

A comparison of FIGS. 3, 5, 6 and 7 reveals that the sheath 15 can be mounted on the boom 1 equipped with the ring or collar 20, by being threaded on said boom in such a way as to bring the endpiece 22 over the free corresponding end portion of the boom. In this position, the plate 23 can be engaged against the corresponding transversal face by taking advantage of the deformability of the sheath 15. In other words, the boom can be equipped with the sheath already fitted with the endpiece 22 and with the plate 23. This permitting the ready equipment of a boom at any time, only the ring 20 needing to be initially fitted.

The sheath 15, once mounted, is brought back by gravity to the position illustrated in FIGS. 3 and 4. In that position, the slit 16 coincides with the bolt rope tunnel 10 and the sheath 15 is then secured axially in position on the boom 1 in the two possible directions of sliding.

When it becomes necessary, for example, to roll up the sail 4, from the positions illustrated in FIGS. 3 and 4, the mandrel 1*a* is driven in rotation by the mechanism 6 after slackening the halyard and at least partly hauling in the sheet 7. The rotation of the mandrel 1*a* causes the sail 4 to be rolled into successive spires inside the sheath 15 which is urged angularly, in the direction of arrow $f_1$ for example, due to the displacement of the contact point between the sail and the boom. Such a point is situated substantially level with the tangent joining the external periphery of the boom 1 to the low point where the bolt-rope engages into the bolt rope tunnel in the mast. The angular displacement of the sheath 15 is made possible by elements 18 and 19, for this very purpose.

Figure 8:
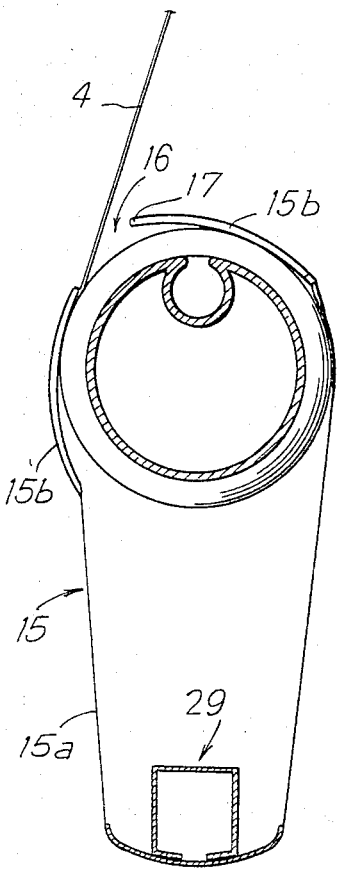
Figure 9:
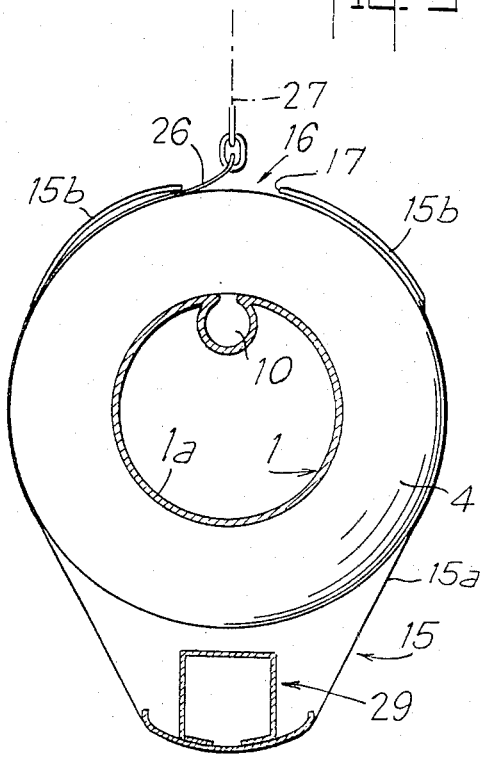

FIG. 8 shows the sail partly rolled, in 10 successive spires for example, over the mandrel 1*a*. FIG. 9 on the contrary shows a boom of identical cross-section as that shown in FIG. 8, but with the sail 4, which is still joined by the tackle 26 to the halyard 27, completely rolled. It is obvious that in this rolled up position, there is no longer any strain exerted by the sail 4 and that, as a result, the sheath 15 can return quite naturally to its initial position wherein the slit 16 is substantially in line with the vertical plane traversing the axle of the boom 1.

The device according to the invention therefore permits the rolling of all or part of a sail, in conventional manner, and to store same readily and easily, to protect it against the elements and the sun radiations. The means used to this effect enable to adapt the sheath 15, for example in section, since the pins 24 enable to vary the cross-section whilst the free engagement of the plate 23 enables the latter to move radially as the section of the boom 1 varies in one way or another.

The means according to the invention are simple to use and have the advantage of being adaptable to the partial or total rolling of the sail. Indeed, the sheath 15, which is supple, can adopt a cross-section adapted to that of the boom 1 when the sail is rolled. As a result, the cross-section of the sheath 15 is in direct relation with the rolling up condition, this giving the boom 1 some particularly advantageous characteristics or an aerodynamical outline. Indeed, the comparison of FIGS. 3, 8 and 9 shows that when the sail is only partly rolled, the surplus perimetric length of the sheath 15 is vertically plumb with the boom, thereby giving the latter a midship frame which reduces to a minimum the coefficient of drag, while defining a kind of vertical extension which increases the overall surface exposed to the wind. The maximum midship frame only occurs when the sail 4 is entirely rolled, i.e. when the boat has stopped, or in particularly difficult conditions of navigation wherein the temporary increase of the midship frame of the boom 1 has no direct repercussion on the speed of the boat.

In order to help the rolling up of the sail 4 and in particular its engagement under the rigid edge defining the slit 16, the sheath 15 can be provided with elastic means placed close to the end of the boom 1 which corresponds to the mast 2. Such elastic means are selected to be able to absorb normally the pressure exerted by the sheath 15, and can be constituted by a draw spring, 28 inserted as illustrated in FIG. 2, between the plate 23 and the mast 2. Although not shown, said draw spring 28 can be replaced by a compression spring inserted directly between the parts of the sleeve 15 resting against the top part of the boom 1.

FIGS. 2 to 5 show that the sheath 15 is preferably associated with a ballast 29 which normally occupies a position substantially diametrically opposite the slit 16. Such a ballast 29 ensures the correct setting of the sheath 15 when the sail 4 is partly or entirely rolled out. Said ballast 29 can be associated to the sheath 15 by being placed outside thereof or else, and preferably, inside the volume defined by the sheath with the external peripheral wall of the boom 1.

Said ballast 29 is preferably constituted by a rigid girder 30 of the U-bar type or of the boxgirder type with a circular or polygonal cross-section. In this last case, the rigid girder 30 is preferably associated to or forms a sole-plate 31 constituting an adequate application and sliding surface for the sheath 15, to avoid any punctual stresses which could damage such a sheath because of its constituting material. The rigid girder 30 preferably extends over the entire length of the sheath to which it is joined axially.

The rigid girder 30 is preferably designed to perform an extra function which is to support at least one point P of application of a pulling force on the boom 1 in the direction of arrow $f_2$. To this effect, the rigid girder 30 comprises at least one hook 32 fitted externally of the sheath 15, so as to fit a traction device 33 such as for example a downhaul. Such a device is known to be used for certain settings of the sail, in order to resist the tendency to bending upwards of the boom 1 under the pull of the sail 4 set between said boom and the mast. According to the invention, the girder 30 then represents a point of application for the pulling force acting in the direction of arrow $f_2$, and ensuring at the same time the transfer of said force to the beam 1 via the sheath 15 and the edges 17.

For the rigid girder 30 to be able to perform such a function, whatever the rolled condition of the sail, a connection is advantageously provided between the girder 30 and the endpiece 22, by means of a stay 34 which ensures an axial junction whilst leaving a possibility for transverse deflection. Thus, the girder 30 can continue to occupy the required low position, whatever the angular deflection inflicted to the sheath 15 by the sail 4, especially when said sail is only partly rolled as illustrated in FIG. 8.

In order to obtain strainlessly this relative displacement of the sheath 15 and of the beam 30, in the case where the girder is set inside the sheath, an indentation 35 is advantageously provided in the material constituting the said sheath, which indentation is perpendicular to the axis of said sheath to allow the passage of the hook 32.

The horizontal component of the pulling force acting in the direction of arrow $f_2$ is thus compensated by the ring 20 whereas the vertical component is compensated by the sail 4.

Figure 6A:
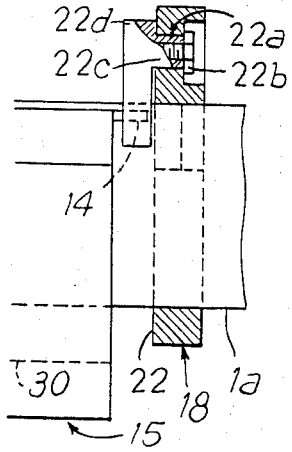

According to a variant embodiment illustrated in FIG. 6*a*, the endpiece 22 can be secured in position on the mandrel 1*a* without being connected to the girder 30. Said endpiece defines at its upper part a curved groove 22*a* centered on the axis of the mandrel 1*a*. Said groove 22*a* is designed to receive, to guide and to hold, particular with a screw 22*b*, the foot 22*c* of a support 22*d* which comprises two bores for engaging the rear pins 24 formed, as indicated hereinabove, in extension of the edges 17. In this way, any angular displacement of the sheath 15 entails a corresponding displacement of the plate 23 and of the support 22*d*, so that the sheath is not subjected to any helical torsion and the slit 16 is always in a rectilinear position.

In order to prevent the rigid edges 17 from bending, especially when a pulling force acts in the direction of arrow $f_2$, the sheath 15 can be produced as a first part 15*a*, forming enclosure, the two edges of which are made up by two rigid laths or blades 15*b*. The adaptation means remain the same and, in particular, the pins 24 are then formed directly by said laths. The connection with the endpiece 22 can be made by rivets 36. The laths 15*b* can be formed by an extra thickness of the material constituting the enclosure 15*a* or else by separate elements built on thereto. In such a case, said enclosure 15*a* can for example be designed so as to comprise hems or loops in which the laths 15*b* are inserted. It is also possible to fix the laths 15*b* by riveting or any other means, provided that the material constituting the enclosure 15*a* permits it. Said laths or blades 15*b* are of relatively constant thickness and relatively wide, and their shape in the rest position is that of a transverse curve, the radius of curvature of which is substantially equal to that defining the external diameter of the boom 1 when the sail is half rolled.

Figure 10:
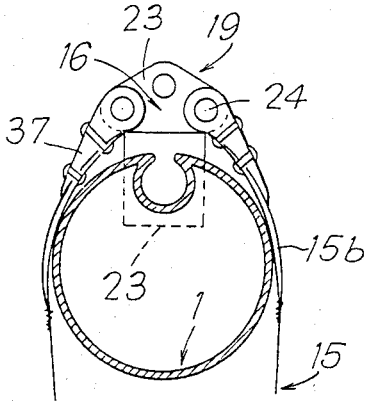
FIG. 10 is an elevational cross-section showing a variant embodiment of one element of the device.

FIG. 10 shows that it is also possible to connect the laths or blades 15*b* with the support and abutting element 19 by way of reinforcing gussets 37 which, in this case, constitute the pins 24.

Figure 11:
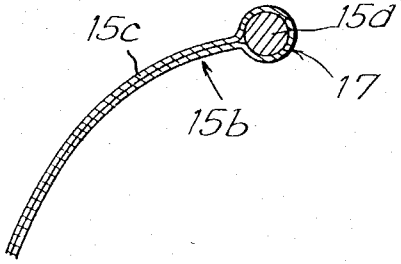
FIG. 11 is a partial transverse view showing a variant embodiment of one of the elements of the invention.
Figure 14:
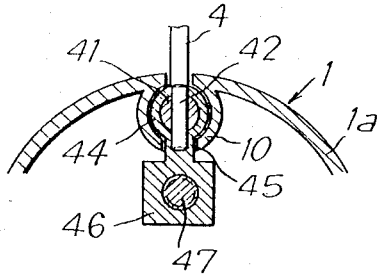
FIG. 14 is a cross-section along line XIV—XIV of FIG. 13, FIGS. 15 and 16 are two cross-sections illustrating two characteristic conditions of a development.

FIG. 11 illustrates another variant embodiment of the laths or blades 15*b*, wherein each lath can be produced from a sheet 15*c* of suitable material, such as sheet metal, by rolling said sheet in the middle over a rod 15*d* so as to form the corresponding edge 17. The two parts of sheet which extend on either side of the rolled portion are coupled together, bent and, at least in parts, adhesively sealed or riveted to form a double-thickness lath. The rolled portion in the middle offers a good sliding surface to the sail 4. Said rolled portion can be displaced sideways towards the inner or outer face of the lath or blade. The rod 15*d* can extend over all or part of the length of the edge 17. And preferably, said rod remains part of the rolled portion and forms on the outside of the corresponding transverse edge of the lath or blade the pin 24 which cooperates with the part 19 or 22*d*.

To ensure a better transmission of the pulling force to the boom 1 and to resist any tendency to bending of the edges 17 it is possible to combine them at least temporarily, with a bending stress-limiting device 38. Such a device can be constituted, as illustrated in FIG. 3, by a straight bar which, when the sail 4 is completely rolled out, is designed to be engaged through the mandrel 1*a*, and simultaneously the blades or laths 15*b* in the middle part of the boom 1. Said bar can also be inserted through the boom only, in which case the boom is perforated so that the laths 15*b* can each rest by their lower end on said bar.

Figure 12:
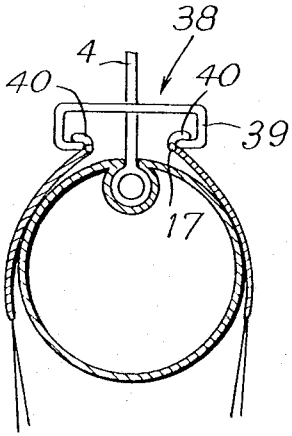
FIG. 12 is a cross-sectional view showing on a larger scale one detail of the invention.

When the sail 4 is partly rolled, the bar 38 stops being usable. But in this case, the sail starting to drop at the level of the boom represents a tractive point remote from the clew which bends the laths or blades. To reduce the serviceable length of the slit to the necessary passage length and thus resist the tendency to bending, a bending stress-limiting device 38 is provided in the form of a stirrup piece, the shanks 39 (FIG. 12) of which cooperate with stiffening grooves or ribs provided on the edges 17. Said grooves or ribs act as slide members allowing the sliding of the stirrup piece to adapt its position in relation to the rolled condition of the sail 4. Said stirrup piece 38 can thus be placed directly level with the point where the sail starts dropping with respect to the boom, i.e. at the spot where the bending moment is applied to the boom when the sail is partly rolled up. The shanks of said stirrup-piece can be at a fixed distance apart or adjustably so.

An equivalent solution, not shown in the drawings, consists in using a stirrup piece 38 and providing holes on the edges 17 or in the grooves or ribs 40, to receive the bent ends of the shanks 39 of the stirrup-piece.

Figures 12A, 15, 16:
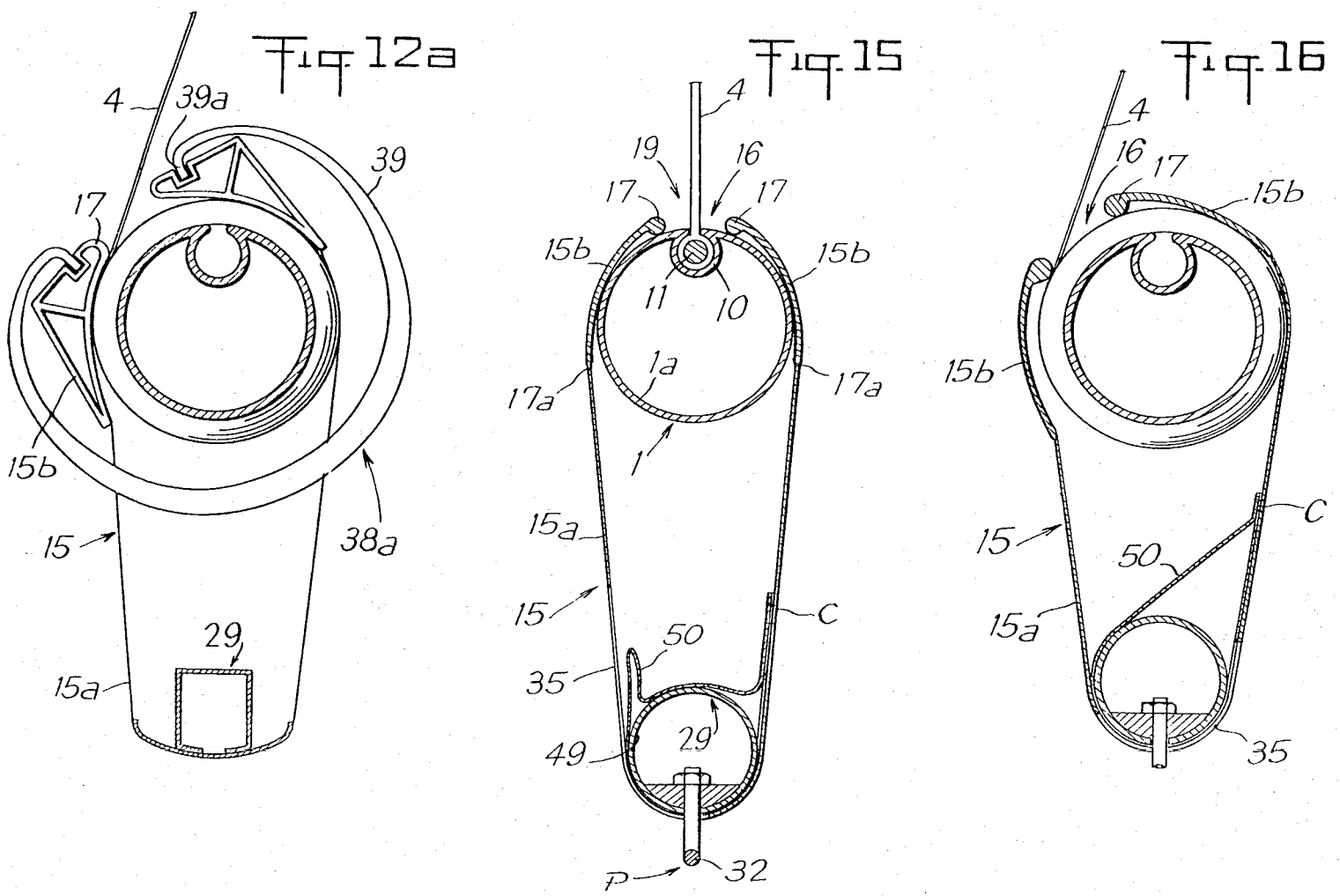
FIG. 12*a* is a view similar to that shown in FIG. 12 showing a variant embodiment of a constitutive element.

FIG. 12*a* shows that the bending stress-limiting device can also be constituted in the form of a stirrup-piece 38*a* designed to encircle the boom from underneath. In such a case, the stirrup-piece is preferably produced as a girder, with equal strength from its middle zone onwards. The ends of the shanks 39 form kinds of hooks 39*a* designed to cooperate with stops provided on the laths 15*b*. FIG. 12*a* shows that it is then advantageous to produce the laths 15*a* in box form, this offering a better resistance to deformation, said boxes being then provided with grooves or holes for engaging the hooks 39*a*. In this case, apertures are then preferably provided here and there in the sheath 15*a* to receive the stirrup piece 38*a* or else said stirrup-piece can have a cross-section in keeping with the maximum rolling up diameter of the boom.

Figure 13:
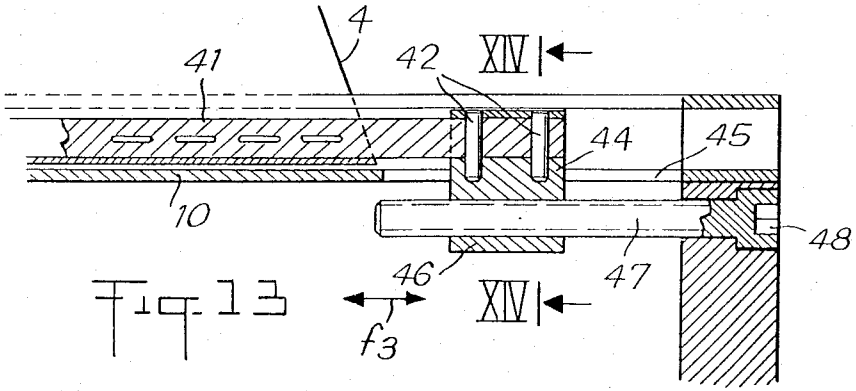
FIG. 13 is an elevational section illustrating another detail of the invention.

Generally speaking, the clew 13 of the sail is associated to the hoisting device by way of a shackle, a hook or snap hook. To reduce the volume space of such a means and to facilitate its engagement into the sheath 15 when the sail is rolled, it is advantageous to constitute a clew in the form of a cylindrical rod 41 (FIGS. 12 and 13) which extends the sail to which it is connected by any suitable means. Said cylindrical rod is added on to extend from the bolt rope so as to be permanently inside the bolt rope tunnel 10. The ring 20 and the endpiece 22 are to this effect designed so as to clear completely the passage into the tunnel 10. Said rod 41 is connected by way of pins 42 with a slide-block 44 engaged, held and guided in and by a slot 45 provided in the bolt rope tunnel. Said slide-block forms a nut 46 placed inside the mandrel 1*a*. The nut 46 is meant to be screwed on a threaded rod 47 the operating head 48 of which is accessible from the transverse face of the free end of the boom 1.

These means represent a hoisting device for the clew 13. Indeed, the rotation in one direction or another of the screw 47 causes the slide-block to move in one or the other direction of arrow $f_3$, and consequently permits to hoist or to ease off the bolt rope, even when the sheath is covering the boom. Such a fitting reduces to a minimum the volume space of the means connecting the clew 13 thus permitting to reduce the radial thickness of the endpiece 22 ensuring the connection with the sheath 15.

FIG. 15 shows a variant embodiment wherein the girder 29 is constituted by a tube 49 of circular cross-section associated to one or more hooks 32, each one of which passes through an indentation 35 provided to this effect in the enclosure 15*a* of the sheath 15. Such a solution enables the girder to have a good mechanical resistance and permits to introduce a smooth relative sliding between the girder and the sheath during the displacement resulting from the partial rolling of the sail 4 on the boom 1.

According to another embodiment of the invention, it is proposed to associate the girder 29 to one or more gussets or loops 50 in supple material, such as for example sailcloth. The developed length of each gusset or loop 50 is such that it freely encircles the girder by passing between the lower surface portion and the enclosure which partly surrounds it. Said gusset or loop is fixed for example by a seam C on the part of enclosure 15*a* corresponding to the lath or blade 15*b* which is urged around the boom when rolling the sail 4, as previously illustrated in FIG. 8. Said gusset or loop 50 is also fixed so that when the sail 4 is rolled out as shown in FIG. 15, the securing point C is situated close to the girder and the surplus length is accumulated in the girder 49.

The length of each gusset or loop 50 is also determined in relation to the position that it occupies so that once the sail 4 is partly rolled, after ten turns for example, the resulting displacement of the sheath, illustrated in FIG. 16, stretches the loop due to the relative sliding between the enclosure 15*a* and the girder 49. Said length is also determined in relation to the length of the indentation or indentations so that the aforesaid stretching occurs with the complete displacement of said indentation with respect to the corresponding hook.

In this position, the gussets or loops act as limiters of relative movement, with in addition another function. Indeed, any downhauling force applied to a hook 32 is transmitted by the girder and the gusset or gussets 50 to the righthand side, according to the drawing, of the enclosure 15*a*, i.e. to the part corresponding to where the blade or lath 15*b* has been brought under the rolling effect at the level of the upper surface presented by the boom. The result of this is a transmission of the tractive force to the boom without any urging of the blade or lath 15*b* which is situated in a plane substantially parallel to the vertical plane, and as a result only offers a small, if any, support with respect to the boom. This arrangement makes is possible for any strong force not to be applied directly to the pins 24 of said blade or lath 15*b*.

Besides the different advantages emerging from the foregoing description, it should also be noted that the sheath 15 can also be used for protecting the rolled sail even for long mooring periods. Indeed, after removing the downhaul or downhauls, the assembly of the sheath 15 can be pivoted over 180° on the boom supporting the completely rolled sail 4. The slit 16 is then level with the lower part of the peripheral wall of the sail-boom assembly. This serves to prevent water infiltrations and the introduction of foreign bodies which, by stagnating, cause a deterioration of the seal 4. The sheath can be kept in that state by means of an ordinary toppinglift, hung on the hook 32 of the girder 29.

The best embodiment of the device according to the invention consists in designing the blades or laths 15*b* such as shown in FIG. 12*a*, designing the girder as shown in FIG. 15, associated to the loop or loops 50, and designing the element 18 as shown in FIG. 6*a*.

What is claimed is:

1. A device for rolling and storing a sail on any kind of rolling and furling boom for storing and protecting, against rain and sun rays, a sail extending substantially between the boom and a mast supporting the boom, the device comprising a sheath of flexible material which:

(a) encompasses the boom and extends over substantially the entire length thereof;

(b) includes rectilinear and rigid edges defining a slit disposed parallel to the longitudinal axis of the boom and disposable at the upper portion thereof for passing the sail therethrough;

(c) is carried by the boom for free swinging movement around the longitudinal axis of the boom; and (d) includes a transverse cross-sectional area at least equal to that of the boom and the sail completely rolled thereon.

2. The device as claim 1 further including:

(a) means carried at the end of the boom mounted to the mast for axially abutting the end of the sheath adjacent thereto; and (b) means carried at the other end of the boom for supporting the end of the sheath adjacent thereto.

3. The device of claim 2 further including at least one elastic suspension member carried at the end of the boom mounted to the mast for supporting pressure imposed by the sheath.

4. The device of claim 1 wherein the sheath further includes an elongate ballast means fastened at one end to the boom and supported on the bottom of the sheath, and disposed substantially diametrically opposite and parallel to the slit when the sail is unrolled from the boom.

5. The device of claim 4 wherein the ballast means includes at least one traction means for resisting bending of the boom in an upward direction.

6. The device of claim 4 wherein the ballast means includes a rigid girder that is fastened adjacent to the end of the boom mounted to the mast by means permitting deflection of the rigid girder within a plane disposed substantially parallel to the boom.

7. The device of claim 4 wherein the ballast means includes a rigid girder extending within an internal space defined by the sheath, and including at least one traction means extending through the sheath for resisting bending of the boom in an upward direction.

8. The device of claim 1 wherein the rigid edges are defined by a pair of opposed blades.

9. The device of claim 8 wherein each blade is transversely curved.

10. The device of claim 8 wherein each blade includes means for limiting bending stress imposed thereon.

11. The device of claim 10 wherein the means for limiting bending stress includes a rigid bar freely engaged through the boom and supporting the blades on the opposite ends of the rigid bar.

12. The device of claim 10 wherein the means for limiting bending stress includes a stirrup provided with a pair of shanks for engaging the rigid blades.

13. The device of claim 1 wherein the rigid edges are defined by a pair of blades and further including:

(a) an elongate ballast means defined by a rigid girder; and (b) means carried at the other end of the boom for supporting the blades and the rigid girder, which means includes a ring secured to the boom and an end piece onto the boom, the end piece being engaged by both the blades and rigid girder.

14. The device of claim 4 wherein the ballast means includes a girder of tubular configuration, the sheath includes at least one gusset disposed in the interior thereof and extending transversely to the longitudinal axis of the sheath, and the girder being engaged by the gusset.

15. The device of claim 2 wherein the means for supporting and axially abutting the sheath includes:

(a) a pin carried by each end of the rigid edges and forming an extension thereof;

(b) a plate carried at the end of the boom mounted to the mast and including perforations for rotatably receiving the pins of the rigid edges therethrough to support and axially abut one end of the sheath; and (c) means carried at the other end of the boom for supporting the other end of the sheath.

16. The device of claim 15 wherein the means carried at the rear end of the boom includes:

(a) an end piece mounted onto the boom and engaged by the rigid edges; and (b) means carried by the end piece for tensioning the bolt rope of the sail.

* * * * *